US005575574A

United States Patent [19]

Mertens

[11] Patent Number: 5,575,574

[45] Date of Patent: Nov. 19, 1996

[54] SHEET COMPOSITE ADAPTED TO BE PRINTED

[75] Inventor: Timothy A. Mertens, Cottage Grove, Wash.

[73] Assignee: Minnesota Mining and Manufacturing Company, St. Paul, Minn.

[21] Appl. No.: 223,778

[22] Filed: Apr. 6, 1994

[51] Int. Cl.[6] ..... B41J 2/00

[52] U.S. Cl. ..... 400/118.2; 101/483; 101/93.01; 40/638; 283/81; 400/120.01; 400/124.01

[58] Field of Search ..... 101/483, 93.01, 101/170, 211, 485; 283/81, 74, 75; 428/40, 192, 194, 42; 40/594, 638; 400/118.2, 118.3, 120.01, 124.01

[56] References Cited

U.S. PATENT DOCUMENTS

| | | | |
|---|---|---|---|
| 4,768,810 | 9/1988 | Mertens | 282/12 A |
| 4,781,306 | 11/1988 | Smith | 221/33 |
| 4,895,746 | 1/1990 | Mertens | 428/40 |
| 5,050,909 | 9/1991 | Mertens et al. | 283/81 |
| 5,056,824 | 10/1991 | Olson | 283/36 |
| 5,114,291 | 5/1992 | Hefty | 283/67 |
| 5,318,825 | 6/1994 | Naber | 428/192 |

FOREIGN PATENT DOCUMENTS

| | | | |
|---|---|---|---|
| 0250124 | 5/1990 | European Pat. Off. . | |
| 512153 | 11/1992 | European Pat. Off. | 283/81 |

OTHER PUBLICATIONS

U.S. Patent Application Ser. No. 07/973,039 filed Nov. 9, 1992 (our Docket No. 49122USA9A).

*Primary Examiner*—Christopher A. Bennett
*Attorney, Agent, or Firm*—Gary L. Griswold; Walter N. Kirn; William L. Huebsch

[57] ABSTRACT

A sheet composite adapted to be printed in printers of the type commonly used with personal or other types of computers including lasers printers, ink jet printers and impact printers. The sheet composite comprises (1) a primary sheet portion having opposite first and second major surfaces of a size adapted to be received by the printers and having first and second opposite edges; (2) a secondary sheet portion having first and second opposite major surfaces and having first and second opposite edges, which secondary sheet portion has a width between its first and second edges that is no more than half the width of the primary sheet portion between its first and second opposite edges; and (3) a layer of pressure sensitive adhesive that is firmly adhered on the first surface of one of the sheet portions along its first edge.

7 Claims, 4 Drawing Sheets

SHEET COMPOSITE ADAPTED TO BE PRINTED

FIELD OF THE INVENTION

The present invention relates to composite materials including a sheet adapted to be printed with indicia and a layer of pressure sensitive adhesive by which the sheet can be adhered to a substrate, and to methods for printing indicia on such sheets.

BACKGROUND OF THE INVENTION

Well known are composite materials or notes each comprising a paper sheet and having a narrow strip of low-peel pressure-sensitive adhesive on one surface adjacent one edge by which the sheet can be temporarily adhered to a substrate such as a document for marking, message-bearing, or other purposes. Pads of such notes are currently being marketed under the trademark "Post-it" brand notes by Minnesota Mining and Manufacturing Company, St. Paul, Minn. Such notes have been printed with indicia (e.g., a message, picture, or decoration), however, heretofore, in most cases such indicia has been printed on large sheets of material from which the notes are formed so that printing of indicia on the notes has only been economically feasible when large quantities of the notes are produced.

A sheet assembly including paper sheets to which are adhered layers of adhesive and a method for custom printing the sheet assembly and assembling it into pads of notes using a copy machine is described in U.S. patent application Ser. No. 07/973,039 filed Nov. 9, 1992, (the entire content whereof is hereby incorporated herein by reference). While the sheet assembly described in that application could be printed in printers of the type commonly used with personal or other types of computers including laser printers, ink jet printers and impact printers, it is not as versatile for that use as may be desired for various reasons, including that adhesive coated sheets included in the sheet material can not readily be printed on both sides should that be desired.

DISCLOSURE OF INVENTION

The present invention provides a sheet composite comprising a sheet coated with pressure sensitive adhesive that is particularly adapted to be printed on one or both sides in printers of the type commonly used with personal or other types of computers including laser printers, ink jet printers and impact printers.

Generally, the sheet composite according to the present invention comprises (1) a primary sheet portion having opposite first and second major surfaces of a size adapted to be received by the printers (e.g., 7.5 by 12 centimeters) and having first and second opposite edges; (2) a secondary sheet portion having first and second opposite major surfaces and having first and second opposite edges, which secondary sheet portion has a width between its first and second edges that is no more than half the width of the primary sheet portion between its first and second opposite edges; and (3) a layer of pressure sensitive adhesive that is firmly adhered on the first surface of one of the sheet portions along its first edge.

Embodiments of the sheet composite can be provided that are ready to be printed in a printer. In those embodiments the first surface of the secondary sheet portion is adjacent the first surface of the primary sheet portion, the first edges of the primary and secondary sheet portions are generally aligned, and the layer of adhesive is therebetween and releasably adhered on the first surface of the sheet portion opposite that to which it is firmly adhered. In those embodiments the secondary sheet portion can either be separate from or connected to the primary sheet portion; the adhesive can be firmly adhered to either of the sheet portions; and the sheet portions can both have a layer of pressure sensitive adhesive firmly adhered on their first surface along their first edges so that both sheet portions can be printed, separated, and adhered to a substrate by a layer of adhesive after they are printed. Also, those embodiments of the sheet composite can be provided in a stack with the sheet composites bound in the stack by a layer of padding compound that is removably adhered to and extends between aligned side surfaces of the stacked sheet composites.

Alternatively, certain embodiments of the sheet composite can be provided in a stack without the use of padding compound. In those embodiments the first edges of the primary and secondary sheets are connected along a line of weakness, the first surfaces of the sheet portions are disposed generally in a common plane, and the sheet composite is easily bendable along the path of weakness to position the first surfaces of the primary and secondary sheet portions adjacent to releasably adhere the layer of pressure sensitive adhesive along the first surface of the sheet portion opposite that to which it is permanently adhered. The layers of adhesive on a plurality of sheet composites of such embodiments can be adhered to the second surfaces of adjacent sheet composites to form the stack, for example, with the layers of adhesive on the sheets adjacent the same edge of the stack, or with the layers of adhesive on successive sheets in the stack on opposite sides of the stack.

The adhesive used in the layer of adhesive can be a low-peel or repositionable type of adhesive, or can be a high peel pressure sensitive adhesive. If needed, the sheet composite can include a layer of release material on the first surface of the sheet to which the layer of adhesive is releasable adhered to facilitate separation of the sheets after the sheet composite material is printed. An almost immeasurably small amount of adhesion is needed between sheet portions attached along one edge to keep them together prior to and during printing. To be sure that sheet portions not attached together will remain adhered together by the adhesive prior to and during printing, however, the force required to peel apart the sheet portions of the sheet composite prior to printing should be at least 3 grams per 25 millimeters of adhesive width (and preferably greater than about 5 grams per 25 millimeters of adhesive width) along the peel line when the sheet portions are peeled apart at a 90 degree angle at 300 millimeters per minute. The force required to peel apart the sheet portions after the sheet composite is printed in a laser printer of the type commercially designated "LaserJet III" that is commercially available from the Hewlett Packard Corporation of Palo Alto, Calif., should be less than 300 grams per 25 millimeters (and preferably less than 25 grams per 25 millimeters) of adhesive width along the peel line when the sheet portions are peeled apart at a 90 degree angle at 300 millimeters per minute to insure that they can be easily and cleanly separated.

The sheets can be of any conventional material (e.g., conventional bond, or clay-coated paper, opaque or translucent polymeric material, or carbonless paper). The adhesive used in the layers of pressure-sensitive adhesive can be a low-peel pressure-sensitive adhesive (e.g., comprising tacky, elastomeric copolymer microspheres) in which case the opposing surface when stacked or covered for printing, can be free of release coating; or a conventional more aggressive pressure-sensitive adhesive can be used in which case the sheet can include a release coating where appropriate. Suitable release materials for these adhesives may be selected from acrylates, urethanes, silicones, fluropolymers, chrome complexes, and the like known in the art. A method for printing a custom printed sheet can include providing a printer of the type commonly used with personal or other types of computers such as a laser printers, an ink jet printer, or an impact printer; providing a manually operable means for forming a message in an electronic form capable of operating the printer in a manner such that the printer will print the message when the printer is actuated and the electronic form of the message is sent to the printer; providing one of the sheet composites described above that has the first surfaces of its primary and secondary sheet portions positioned adjacent and the layer of pressure sensitive adhesive adhering them together; forming a desired message using the manually operable means; sending the message in its electronic form to the printer to thereby actuate the printer; feeding the sheet composite through the printer (i.e., by using either the paper feed tray or "bypass" feeding feature of the printer) so that the message is printed on the sheet composite; and separating the secondary sheet portion from the primary sheet portion so that the printed sheet composite can be adhered to a substrate or adhered to other printed sheet composites to form a pad or booklet using the layer of pressure sensitive adhesive.

Where the sheet composite is provided in a stack, the method can further include the steps necessary to remove the sheet composite from the stack, and, if necessary, to manually bend the sheet composite along the path of weakness prior to the feeding step to position the first surface of the primary and secondary sheet portions adjacent so that the layer of pressure sensitive adhesive is adhered along the first surfaces of both of the sheet portions.

Also, where the primary and secondary sheet portions are joined along their first edges and the layer of adhesive is firmly adhered on the first surface of the secondary sheet portion; the method can further include printing a plurality of custom printed sheets using the method steps set out above; and adhering the layers of adhesive on the secondary sheets to the second surfaces of other secondary sheets with the edges of the secondary sheets aligned to form a pad or booklet.

The sheet composite and method described above provide a convenient and versatile approach that can be used by individuals or commercial establishments to custom print small quantities of notes, labels, flags, signs, receipts, and the like. The adhesive is covered and protected during printing, and yet is easily exposed, even following exposure of the sheet composite to the pressures and temperatures involved in electrophotographic printing. Individual printed sheet composite may be retained with their sheet portions adhered together until they are ready for use. Alternatively, the sheet portions of several printed sheet composites can be separated and the sheet composites then stacked into a pad or booklet. Subsequently, the sheet portions of such individual printed sheet composites can be separated, or printed sheet composites can be separated from the pad or booklet and adhered to the surface of a substrate.

BRIEF DESCRIPTION OF THE DRAWING

The present invention will be further described with reference to the accompanying drawing wherein like reference numerals refer to like parts in the several views, and wherein.

DETAILED DESCRIPTION OF THE EMBODIMENTS

Figure 1:
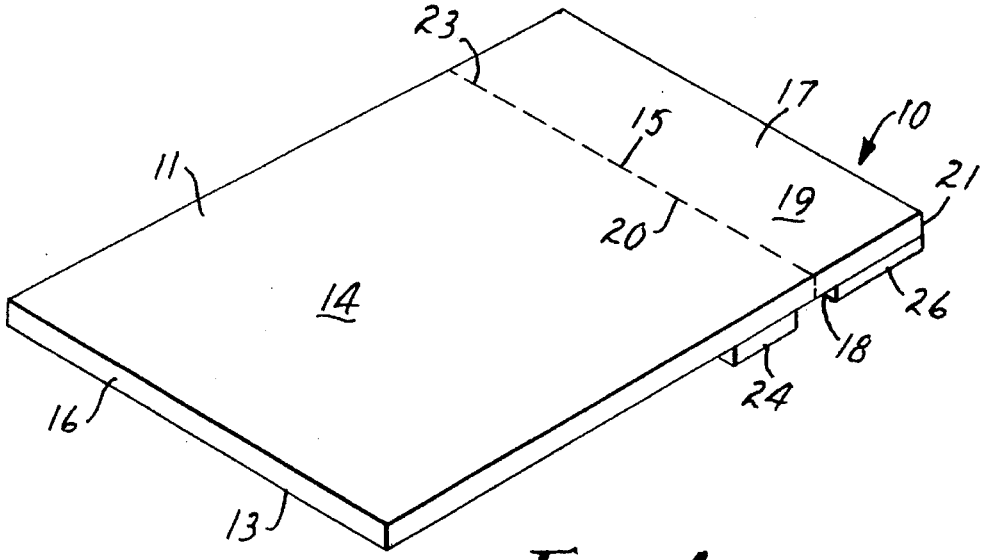
FIG. 1 is a perspective view of a first embodiment of a sheet composite according to the present invention.

Referring now to FIGS. 1 through 4 of the drawing, there is illustrated a first embodiment of a sheet composite according to the present invention generally designated by the reference numeral 10.

The sheet composite 10 comprises a primary sheet portion 11 having opposite first and second major surfaces 13 and 14 and having first and second opposite edges 15 and 16, which major surfaces 13 and 14 are of a size adapted to be received by printers of the type commonly used with personal or other types of computers including laser printers, ink jet printers and impact printers. Also included in the sheet composite 10 is a secondary sheet portion 17 having first and second opposite major surfaces 18 and 19 and having first and second opposite edges 20 and 21. The secondary sheet portion 17 has a width between its first and second edges 20 and 21 that is no more than one half of the width of the primary sheet portion 11 between its first and second opposite edges 15 and 16, and as illustrated is less than one third of the width of the primary sheet portion 11 between its first and second opposite edges 15 and 16. The primary and secondary sheet portions 11 and 17 are made from one sheet of paper that is perforated along the first edges 15 and 20 so that they are joined with the first surfaces 13 and 18 of the sheet portions on corresponding sides of the sheet, and so that the perforations provide a linear path of weakness 23. The sheet portions 11 and 17 can be torn apart along that path of weakness 23 while the parts of the sheet between the perforations provide sufficient integrity so that the sheet does not separate along that path of weakness 23 while being printed. The sheet can be bent about the path of weakness 23 from an initial position (FIGS. 1 and 2) with the first surfaces 13 and 18 of the sheet portions 11 and 17 generally in the same plane, to a ready position (FIGS. 3 and 4) with the first surfaces 13 and 18 of the sheet portions 11 and 17 adjacent, at which ready position the sheet composite 10 is ready to be fed into a printer. The sheet composite 10 further includes a layer of pressure sensitive adhesive 24 along the first surface of the one of the sheet portions (i.e., the first surface 13 of the primary sheet portion 11 as illustrated) adjacent the path of weakness 23, and a layer of release material 26 on the other of the sheet portions (i.e., the first surface 18 of the secondary sheet portion 17 as illustrated) so that the layer of adhesive 24 will be adhered along the layer of release material 26 when the sheet is bent along the path of weakness 23 to place the first surfaces 13 and 18 of the sheet portions 11 and 17 closely adjacent in the ready position of the sheet composite 10.

Figure 2:
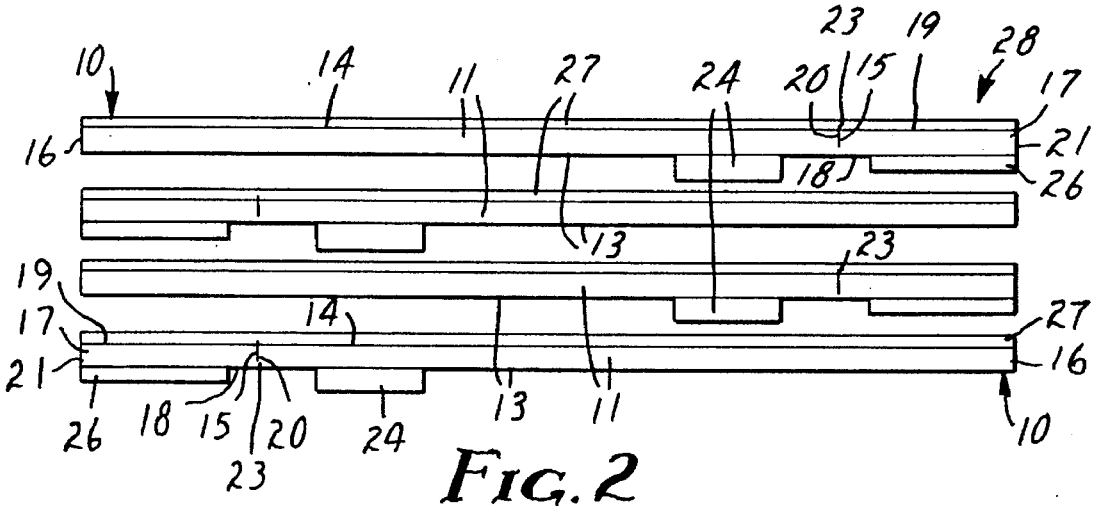
FIG. 2 is a side view of a plurality of the sheet composites illustrated in FIG. 1 adhered together in a stack.
Figure 3:
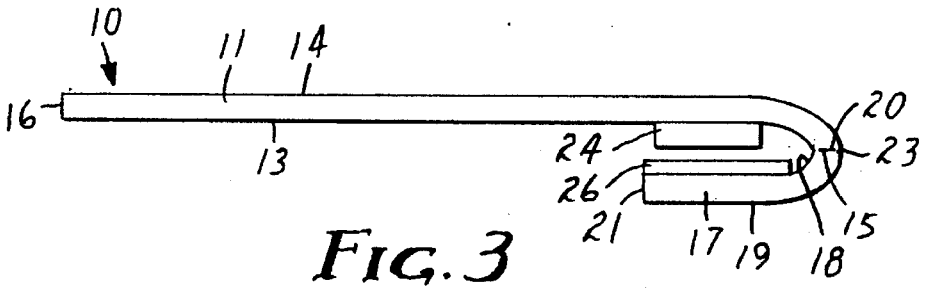
FIG. 3 is a side view of the sheet composite of FIG. 1 in which a secondary sheet portion has been moved to a position where it is adhered to a primary sheet portion by a layer of adhesive.
Figure 4:
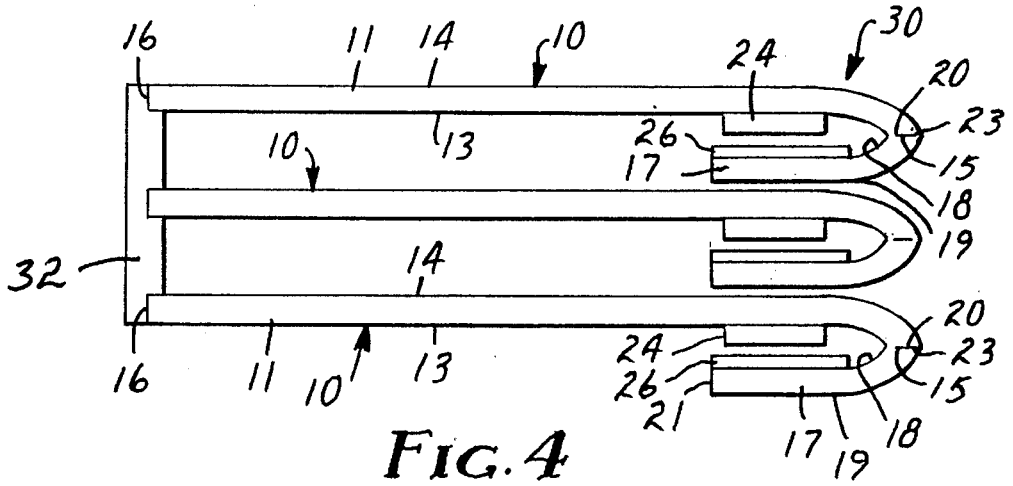
FIG. 4 is a side view of a plurality of the sheet composites of FIG. 1 having their second portions positioned as in FIG. 2 with the sheet composites adhered together in a stack by a layer of padding compound.

FIG. 2 illustrates a plurality of the sheet composites 10 as illustrated in FIG. 1 in a stack 28 with the layers 24 of adhesive on the sheet composites 10 releasably adhered to the second surfaces 14 of adjacent sheet composites 10 which are modified from the sheet composites illustrated in FIGS. 1, 3 and 4 by being coated with release material 27 along the second surfaces 14 and 19. The sheet composites 10 could have been stacked with the layers 24 of adhesive on the sheet composites 10 adjacent the same edge of the stack. As illustrated, however, the sheet composites 10 are stacked with the layers 24 of adhesive on successive sheet composites 10 in the stack 28 on opposite edges of the stack 28 which allows them to be dispensed in dispensers of the type described in U.S. Pat. Nos. 4,986,440 and 4,653,666, the contents whereof are incorporated herein by reference.

FIG. 4 illustrates a stack 30 of a plurality of the sheet composites 10 with their primary and secondary sheet portions 11 and 17 in the ready position. The stack 30 includes a layer 32 of padding compound extending generally normal to the first surfaces 13 and 18 along aligned edges 16 of the sheet composites 10, which layer 32 of padding compound is removably adhered to and extends between those aligned edges on one side of the stack 30 so that an individual one of the sheet composites 10 can be easily removed from the stack 30 by peeling it away from the layer 32 of padding compound.

Figure 5:
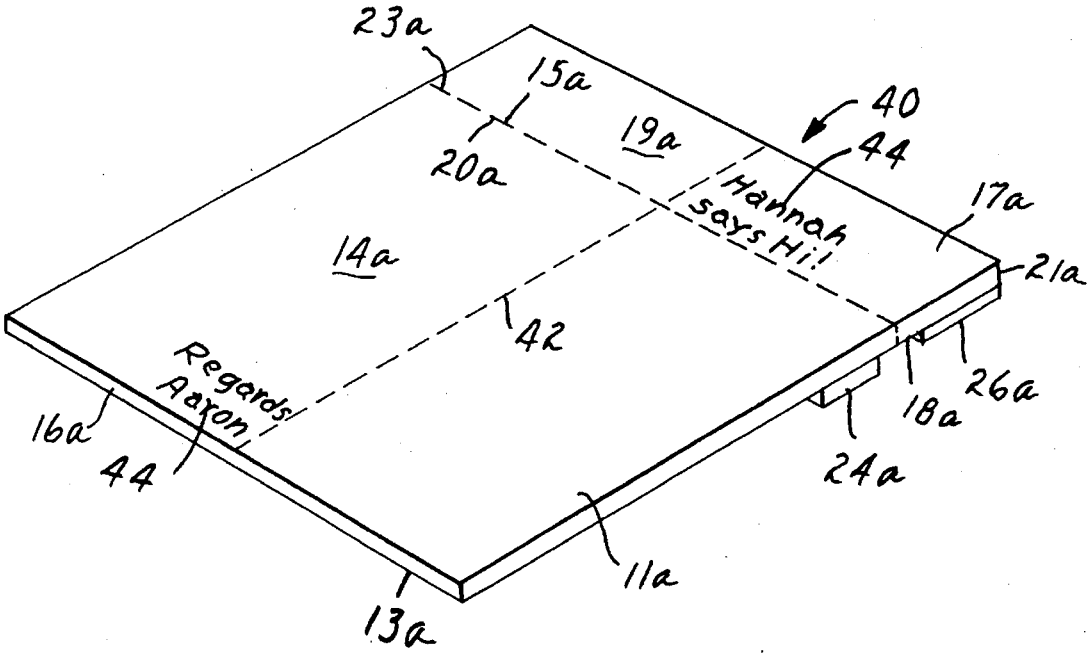
FIG. 5 is a perspective view of a second embodiment of a sheet composite according to the present invention.

FIG. 5 illustrates a sheet composite 40 that is essentially the same as the sheet composite 10 (with similar parts being identified with similar reference numerals to which has been added the suffix "a") except that the sheet portions 11*a* and 17*a* are wider and are perforated so that they have a transverse path of weakness 42 extending at a right angle to the first edges 15 and 20 of the sheet portions 11*a* and 17*a*, along which path of weakness 42 the primary and secondary sheet portions 11*a* and 17*a* can be easily manually separated. The path of weakness 42 allows the sheet composite 40 to be printed with indicia such as the indicia 44 to provide, for example, two notes or two labels which could be separated and put to different uses, or stacked with other printed sheet composites 40 and then separated to form two pads.

Figure 6:
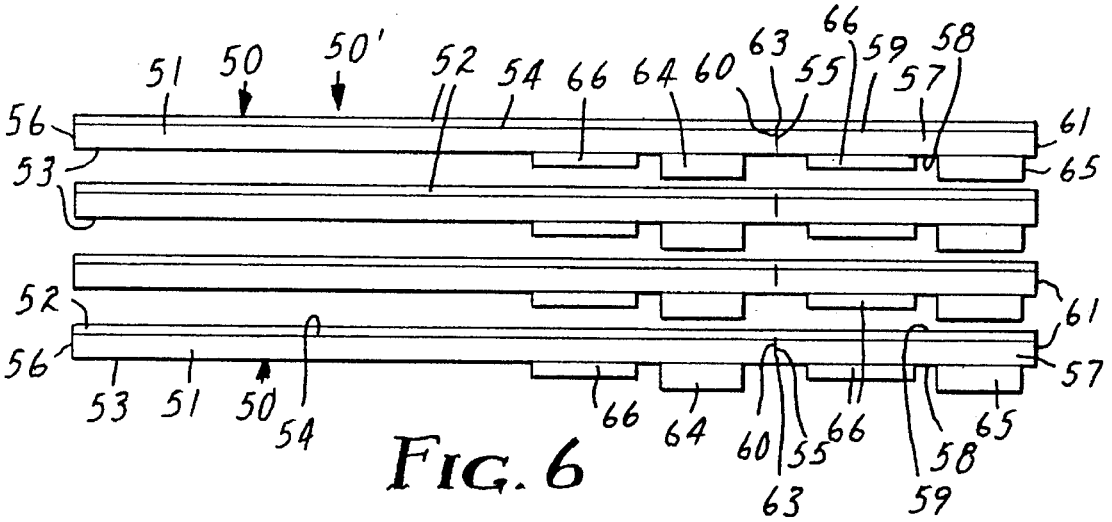
FIG. 6 is a side view of a plurality of sheet composites adhered together in a stack, which sheet composites are third embodiments of a sheet composite according to the present invention.
Figure 7:
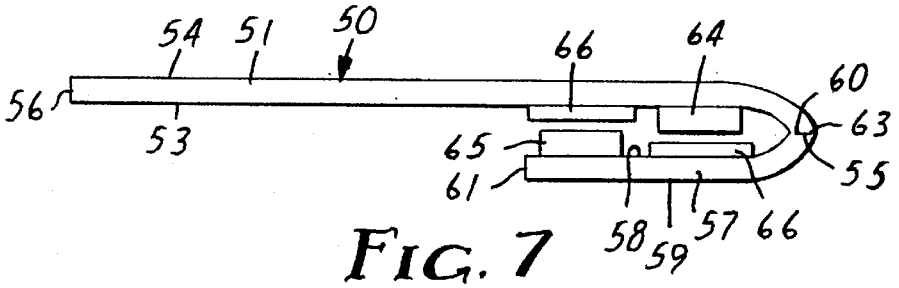
FIG. 7 is a side view of one of the sheet composites illustrated in FIG. 6 that has removed from the stack and in which a secondary sheet portion has been moved to a position where it is adhered to a primary sheet portion by two layers of adhesive.

FIGS. 6 illustrates a stack 50' of sheet composites 50 according to the present invention, and FIG. 7 illustrates one of the sheet composites 50 that is similar to those in the stack 50' except that it does not have a coating 52 of release material on surfaces 54 and 59 that facilitates removal of sheet composites 50 from the stack 50' . Like the sheet composite 10, each of the sheet composites 50 comprises a primary sheet portion 51 having opposite first and second major surfaces 53 and 54 and having first and second opposite edges 55 and 56, which major surfaces 53 and 54 are of a size adapted to be received by printers of the type commonly used with personal or other types of computers including laser printers, ink jet printers and impact printers. Also, the sheet composite 50 includes a secondary sheet portion 57 having first and second opposite major surfaces 58 and 59 and having first and second opposite edges 60 and 61. The secondary sheet portion 57 has a width between its first and second edges 60 and 61 that is no more than one half of the width of the primary sheet portion 51 between its first and second opposite edges 55 and 56. The primary and secondary sheet portions 51 and 57 are made from one sheet of paper that is perforated (e.g., microperforated) along the first edges 55 and 60 so that they are joined with the first surfaces 53 and 58 of the sheet portions on corresponding sides of the sheet, and so that the perforations provide a linear path of weakness 63 about which the sheet can be bent from an initial position illustrated in FIG. 6 with the first surfaces 53 and 58 of the sheet portions 51 and 57 generally in the same plane, to a ready position illustrated in FIG. 7 with the first surfaces 53 and 58 of the sheet portions 51 and 57 adjacent, at which ready position the sheet composite 50 is ready to be fed into a printer. The sheet composite 50 further includes two layers 64 and 65 of pressure sensitive adhesive on the sheet portions 51 and 57 respectively that extend side by side between the adjacent first surfaces 53 and 58 of the sheet portions 51 and 57 in the ready position of the sheet composite 50 illustrated in FIG. 7. In the ready position of the sheet composite 50 the adhesive of the layer 64 is firmly adhered on the first surface 53 of the primary sheet portion 51 and is releasably adhered on the first surface 58 of the secondary sheet portion 57, whereas the adhesive of the layer 65 is firmly adhered on the first surface 58 of the secondary sheet portion 58 and is releasably adhered on the first surface 53 of the primary sheet portion 51. The sheet portions 51 and 57 also have layers of release material 66 on the first surfaces 53 and 58 of the sheet portions 51 and 57 in positions along which the layers of adhesive 64 and 65 will be adhered when the sheet composite 50 is bent along the path of weakness 63 to place the first surfaces 53 and 58 of the sheet portions 51 and 57 closely adjacent in the ready position of the sheet composite 50. The use of the two strips of adhesive 64 and 65 will more firmly adhere the sheet portions 51 and 57 together than a single strip of adhesive. Also, both sheet portions 51 and 57 can be printed, and subsequently the secondary sheet portion 57 can be separated from the primary sheet portion 51 along the perforations forming the path of weakness 63 and both sheet portions 51 and 57 can be adhered to substrates.

Figure 8:
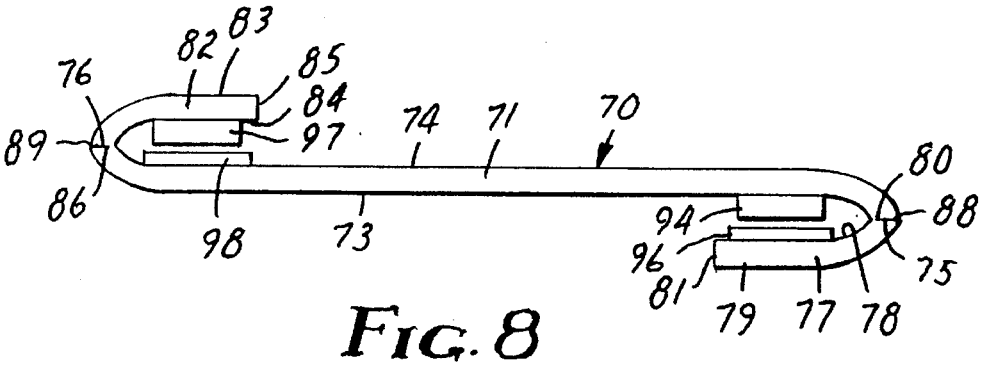
FIG. 8 is a side view of a fourth embodiment of a sheet composite according to the present invention.

FIG. 8 illustrates a sheet composite 70, that like the sheet composite 10 comprises a primary sheet portion 71 having opposite first and second major surfaces 73 and 74 and having first and second opposite edges 75 and 76, which major surfaces 73 and 74 are of a size adapted to be received by printers of the type commonly used with personal or other types of computers including laser printers, ink jet printers and impact printers. Also included in the sheet composite 70 is a secondary sheet portion 77 having first and second opposite major surfaces 78 and 79 and having first and second opposite edges 80 and 81; and a third sheet portion 82 having first and second opposite manor surfaces 83 and 84 and having first and second opposite edges. 85 and 86. The secondary and third sheet portions 77 and 82 have widths between their first and second edges 80 and 81 that are no more than one half of the width of the primary sheet portion 71 between its first and second opposite edges 75 and 76, and as illustrated are less than one third of the width of the primary sheet portion 71 between its first and second opposite edges 75 and 76. The primary, secondary and third sheet portions 71, 77 and 82 are made from one sheet of paper that is perforated (e.g., microperforated) along the first edges 75 and 80 and along the second edges 76 and 86 so that they are joined with the first surfaces 73, 78 and 83 of the sheet portions 71, 77 and 82 on corresponding sides of the sheet, and so that the perforations provide linear paths of weakness 88 and 89 about which the sheet can be bent from an initial position (not shown) with the first surfaces 73, 78 and 83 of the sheet portions 71, 77 and 82 generally in the same plane, to a ready position illustrated in FIG. 7 with the first surfaces 73 and 78 of the primary and secondary sheet portions 71 and 77 adjacent and with the second surfaces 74 and 84 of the primary and third sheet portions 71 and 82 adjacent, at which ready position the sheet composite 70 is ready to be fed into a printer. A layer of pressure sensitive adhesive 94 is adhered along the first surface of the one of the primary and secondary sheet portions (i.e., the first surface 73 of the primary sheet portion 71 as illustrated) adjacent the path of weakness 88, and a layer of release material 96 is on the first surface of the other of the sheet portions (i.e., the first surface 78 of the secondary sheet portion 77 as illustrated) so that the layer of adhesive 94 will be adhered along the layer of release material 96 when the sheet is bent along the path of weakness 88 to place the first surfaces 73 and 78 of the primary and secondary sheet portions 71 and 77 closely adjacent in the ready position of the sheet composite 70. Also, a layer of pressure sensitive adhesive 97 is adhered along the second surface of the one of the primary and third sheet portions (i.e., the second surface 84 of the third sheet portion 82 as illustrated) adjacent the path of weakness 89, and a layer of release material 98 is on the second surface of the other of the sheet portions (i.e., the second surface 74 of the primary sheet portion 71 as illustrated) so that the layer of adhesive 97 will be adhered along the layer of release material 98 when the sheet is bent along the path of weakness 89 to place the second surfaces 74 and 84 of the primary and third sheet portions 71 and 82 closely adjacent in the ready position of the sheet composite 70.

Figure 9:
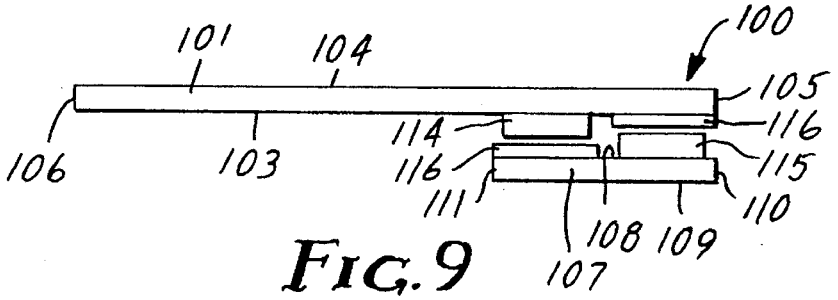
FIG. 9 is a side view of a fifth embodiment of a sheet composite according to the present invention.

FIG. 9 illustrates another embodiment of a sheet composites 100 according to the present invention which comprises a primary sheet portion 101 having opposite first and second major surfaces 103 and 104 and having first and second opposite edges 105 and 106, which major surfaces 103 and 104 are of a size adapted to be received by printers of the type commonly used with personal or other types of computers including laser printers, ink jet printers and impact printers. Also, the sheet composite 100 includes a secondary sheet portion 107 having first and second opposite major surfaces 108 and 109 and having first and second opposite edges 110 and 111. The secondary sheet portion 107 has a width between its first and second edges 110 and 111 that is no more than one half (and less than one quarter as illustrated) of the width of the primary sheet portion 101 between its first and second opposite edges 105 and 106. The primary and secondary sheet portions 101 and 107 are two separate sheets of paper positioned in a ready position illustrated with the first surfaces 103 and 108 of the sheet portions 101 and 107 adjacent, at which ready position the sheet composite 100 is ready to be fed into a printer. The sheet composite 100 further includes two layers 114 and 115 of pressure sensitive adhesive on the sheet portions 101 and 107 respectively that extend side by side between the adjacent first surfaces 103 and 108 of the sheet portions 101 and 107. The adhesive of the layer 114 is firmly adhered on the first surface 103 of the primary sheet portion 101 and is releasably adhered on the first surface 108 of the secondary sheet portion 107, whereas the adhesive of the layer 115 is firmly adhered on the first surface 108 of the secondary sheet portion 108 and is releasably adhered on the first surface 103 of the primary sheet portion 101. The sheet portions 101 and 107 also have layers of release material 116 on the first surfaces 103 and 108 of the sheet portions 101 and 107 in positions along which the layers of adhesive 114 and 115 are adhered. Both sheet portions 101 and 107 can be printed, and subsequently separated and adhered to substrates.

Figure 10:
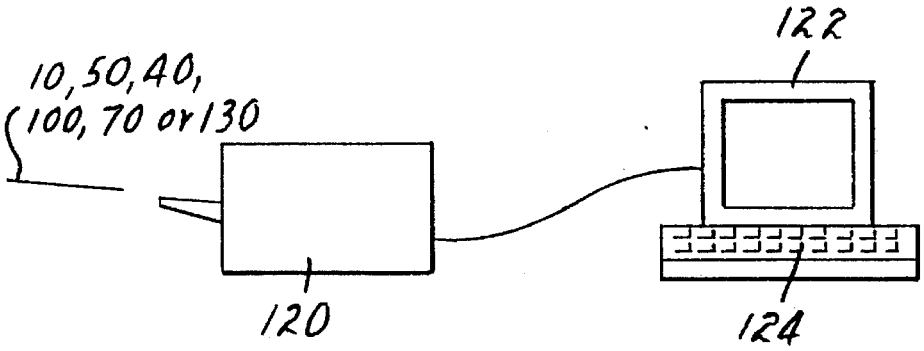
FIG. 10 is a schematic view of a method of forming printed sheets using the sheet composites according to the present invention.

FIG. 10 schematically illustrates a method for printing a custom printed sheet from any one of the sheet composites described above. That method includes providing a printer 120 of the type commonly used with personal or other types of computers such as a laser printers, an ink jet printer, or an impact printer; providing a manually operable means (e.g., a computer 122) for forming a message in an electronic form capable of operating the printer 120 in a manner such that the printer 120 will print the message when the printer 120 is actuated and the electronic form of the message is sent to the printer 120; providing one of the sheet composites described above that has the first surfaces of its primary and secondary sheet portions positioned adjacent and its layer of pressure sensitive adhesive adhering them together; forming a desired message using the manually operable means (e.g. manually typing the message in at a keyboard 124 associated with the computer 122); actuating the printer 120; sending the message in its electronic form to the printer 120 (e.g., by actuating the print function of the computer 122); feeding the sheet composite through the printer 120 (i.e., by using either the paper feed tray or "bypass" feeding feature of the printer 120) so that the message is printed on the sheet composite; and separating the secondary sheet portion from the primary sheet portion so that the printed sheet composite can be adhered to a substrate or adhered to other printed sheet composites to form a pad or booklet using the layer of pressure sensitive adhesive.

Where the sheet composite to be printed is provided in a stack, the method can further include the steps necessary to remove the sheet composite from the stack, and, if necessary, to manually bend or rotate the sheet composite along the path of weakness prior to the feeding step to position the first surface of the primary and secondary sheet portions adjacent so that the layer of pressure sensitive adhesive is adhered along the first surfaces of both of the sheet portions.

Figure 11:
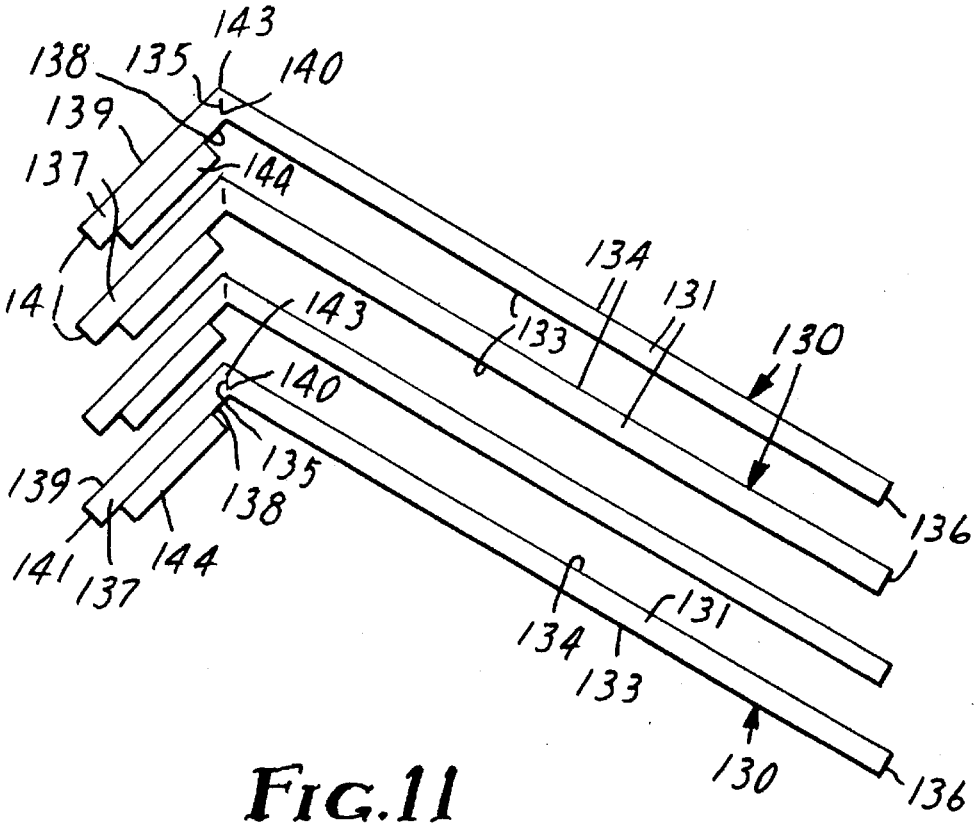
FIG. 11 is a side view of a plurality of sheet composites according to the present invention adhered together to form a pad or booklet, which sheet composites are a sixth embodiment of the sheet composite.

Also, where the primary and secondary sheet portions are joined along their first edges and the layer of adhesive is firmly adhered on the first surface of the secondary sheet portion; the method can further include printing a plurality of custom printed sheets using the method steps set out above; and adhering the layers of adhesive on the secondary sheets to the second surfaces of other secondary sheets with the edges of the secondary sheets aligned to form a pad or booklet. Such a pad or booklet is illustrated in FIG. 11 where a stack of printed sheet composites 130 each comprise a primary sheet portion 131 having opposite first and second major surfaces 133 and 134 and having first and second opposite edges 135 and 136, Which major surfaces 133 and 134 are of a size adapted to be received by printers of the type commonly used with personal or other types of computers. Also included in the sheet composite 130 is a secondary sheet portion 137 having first and second opposite major surfaces 138 and 139 and having first and second opposite edges 140 and 141. The secondary sheet portion 137 has a width between its first and second edges 140 and 141 that is no more than one half of the width of the primary sheet portion 131 between its first and second opposite edges 135 and 136, and as illustrated is less than one third of the width of the primary sheet portion 131 between its first and second opposite edges 135 and 136. The primary and secondary sheet portions 131 and 137 are made from one sheet of paper that is creased along the first edges 135 and 140 so that they are joined with the first surfaces 133 and 138 of the sheet portions on corresponding sides of the sheet, and so that the creased area of the sheet provides a linear path of weakness 143. The sheet can be bent about the path of weakness 143 from an initial position (not shown) with the first surfaces 133 and 138 of the sheet portions 131 and 137 generally in the same plane, to a ready position (also not shown) with the first surfaces 133 and 138 of the sheet portions 131 and 137 adjacent, at which ready position the sheet composite 130 is ready to be fed into a printer. The sheet composite 130 further includes a layer of pressure sensitive adhesive 144 along the first surface of the one of the sheet portions (i.e., the first surface 138 of the secondary sheet portion 137 as illustrated) adjacent the path of weakness 143, and a layer of release material (not illustrated) can be applied on the other of the sheet portions (i.e., the first surface 133 of the primary sheet portion 131 as illustrated) so that the layer of adhesive 144 will be adhered along the layer of release material when the sheet is bent along the path of weakness 143 to place the first surfaces 133 and 138 of the sheet portions 131 and 137 closely adjacent in the ready position of the sheet composite 130.

After a plurality of the sheet composites 130 are printed using the method described above, their sheet portions 131 and 137 can be separated and their adhesive layers adhered together as illustrated in FIG. 11 to form the pad or booklet which can either be temporarily or permanently adhered together depending the adhesive used. As illustrated, the sheets composites 130 can be partially folded along their paths of weakness 143 and then allowed to settle on each other along their folded paths of weakness 143 to facilitate forming the pad or booklet.

EXAMPLES

Examples of certain embodiments of the sheet composites described above were made, and those example sheet composites were tested to determine the force required to separate the secondary sheet portions from the primary sheet portions both (1) after their primary and secondary sheet portions were adhered together by the layer of adhesive in their ready position but prior to printing and (2) after they are printed. The tests to determine the force required to separate the secondary sheet portions from the primary sheet portions after they were adhered together and prior to printing was performed on each sheet composite by separating the secondary sheet portion from the primary sheet portion along the line of weakness therebetween, adhering the primary and secondary sheet portions together in the position they would be adhered together in the ready position if they were still attached along the line of weakness, laminating the sheet portions together in the manner described in FINAT Method #2, attaching the primary sheet portion to a platform on a testing machine using a double-coated tape with the secondary sheet portion on the side of the primary sheet portion opposite the platform, causing the testing machine to peel the secondary sheet portion from the primary sheet portion at 300 millimeters per minute while pulling the secondary sheet away from the primary sheet at an angle of 90 degrees to the first surface of the primary sheet, and recording the force required to peel the secondary sheet portion from the primary sheet portion.

The tests to determine the force required to separate the secondary sheet portions from the primary sheet portions after they were adhered together and printed was performed on each sheet composite with its sheet portions adhered and laminated together in the ready position by printing indicia on the primary sheet portion using a "LaserJet III" printer commercially available from the Hewlett-Packard Corporation of Palo Alto, Calif., making a cut 0.5 mm from the first edges of the primary and secondary sheets to remove the path of weakness, attaching the primary sheet portion to a platform on a testing machine using a double-coated tape with the secondary sheet portion on the side of the primary sheet portion opposite the platform, causing the testing machine to peel the secondary sheet portion from the primary sheet portion at 300 millimeters per minute while pulling the secondary sheet away from the primary sheet at an angle of 90 degrees to the first surface of the primary sheet, and recording the force required to peel the secondary sheet portion from the primary sheet portion.

EXAMPLE 1

Sheet composites generally like the sheet composites 10 illustrated in FIG. 1 were made using 14 cm × 42 cm pieces of 20 pound bond paper commercially available under the trade designation "Astrobright" from Wausau Papers, Wausau, Wis. Release material for the coatings 26 was prepared by mixing 100 g of "Syl-Off" 7610 and 5 g "Syl-Off" 7611 (both commercially available from Dow Corning Corp.), 50 g of 3 micron zinc oxide, and 100 g 2-butanone. The coatings 26 of release material were applied along the 42 cm long edges of the sheets in a 2 cm wide stripes by drag-coating (i.e., by drawing the paper sheets under a smooth bar) after which the coatings 26 of release material were dried and cured. Adhesive for use in the layers 24 of adhesive was prepared from a suspension in organic solvent (i.e., 8 percent solids content) of 10 parts of the copolymer of 95% iso-octyl acrylate and 5% acrylic acid and 90 parts of tacky elastomeric copolymer microspheres ranging in diameter from about 10 to 150 micrometers. The adhesive was coated onto a silicone treated paper using a slot with a 0.2 mm orifice, and was dried. The adhesive on 13 mm wide strips of the adhesive coated silicone treated paper was applied 3 mm from and parallel to the coatings 26 of release material on the paper sheets and laminated to the sheets, after which the silicone treated paper strips were removed. Subsequently, the sheets were microperforated to form the paths of weakness 23. The secondary sheet portions 17 were rotated about the paths of weakness 23 to adhere the layers 24 of adhesive to the coatings 26 of release material. The resultant sheet composites 10 were trimmed to 12.2 millimeter by 20.5 millimeter and were printed on their second surfaces using the Hewlett Packard "LaserJet III" laser printer. Some of the printed sheet composites were unfolded and attached to substrates as custom printed notes, whereas others were unfolded and the second panel detached prior to use as notes. Still others were unfolded, aligned by manually jogging the sheets on the lower edge, and stacked to form custom-printed note pads. The testing described above was performed on the sheet composites and showed that the force required to separate the secondary sheet portions from the primary sheet portions after their primary and secondary sheet portions were adhered together by the layer of adhesive in their ready position but prior to printing was about 2 grams per inch, and that the force required to separate the secondary sheet portions from the primary sheet portions after they are printed was about 6 grams per inch.

EXAMPLE 2

Sheet composites generally like the sheet composites 40 illustrated in FIG. 5 were made using the materials and techniques described in Example 1, except that second microperforation were made in the sheets to form the lines of weakness 42. The sheet composites were printed using the Hewlett Packard "LaserJet III" laser printer by passing the sheet composites 40 through the printer twice to print both the primary sheet portion 11*a* and the secondary sheet portion 17*a*. Some of the printed sheets were put to use as custom printed notes, others were aligned stacked by partially unfolding the secondary sheet portions, laying one sheet on top of the next, and then separated the sheets along the lines of weakness 42 to form two pads. The testing described above was performed on the sheet composites 40 and showed that the force required to separate the secondary sheet portions from the primary sheet portions after their primary and secondary sheet portions were adhered together by the layer of adhesive in their ready position but prior to printing was about 2 grams per inch, and that the force required to separate the secondary sheet portions from the primary sheet portions after they are printed was about 6 grams per inch.

EXAMPLE 3

Sheet composites generally like the sheet composites 50 illustrated in FIG. 7 were made using the sheets of 20 pound bond paper and release material described in Example 1. The layers 64 and 65 of adhesive were made using "Scotch" 9415 a double-coated tape having a low-peel adhesive on one side and a permanent on the other that is commercially available as "Scotch" 9415 from Minnesota Mining and Manufacturing Company, St. Paul, Minn., by laminating the permanent side of the tape to the sheet, and removing the liner to expose the "low-tack" adhesive. The coating 66 of release material on the primary sheet portion 51 was coated, dried, and cured as described in Example 1 to provide a 30 mm wide coating of release material located 57 mm from one edge. 12 mm wide adhesive layers 65 and 64 made from the double-coated tape were laminated 2 mm and 45 mm from that same edge, and the tape liners were removed. The release material 66 on the secondary sheet portion 57 was provided by adhearing thereto a strip, 25 mm wide, of "Scotch" #810 tape commercially available from Minnesota Mining and Manufacturing Company, which strip provided both the release material 66 and reinforcing for the secondary sheet portion 57. The sheets were microperforated 34 mm from the and parallel to the edges of the paper sheets to form the path of weakness 63. Other paths of weakness (not shown in FIG. 7) were made by microperforation to divide the sheets into fourths. The sheets were printed on the both sides with a Hewlett Packard "LaserJet III" laser printer. Some sheets were unfolded and attached as custom printed notes, others were unfolded and the second panel detached prior to use. The first panel was used as a note, and the second panel was attached to the document, so the tape-reinforced section extended past the document edge. The testing described above was performed on the sheet composites 50 and showed that the force required to separate the secondary sheet portions from the primary sheet portions after their primary and secondary sheet portions were adhered together by the layer of adhesive in their ready position but prior to printing was about 2 and 6 grams per inch respectively for the adhesive adheared to the release material and for the adhesive adheared to the "Scotch" #810 tape, and that the force required to separate the secondary sheet portions from the primary sheet portions after they are printed was about 10 and 12 grams respectively for the adhesive adheared to the release material and for the adhesive adheared to the "Scotch" #810 tape.

EXAMPLE 4

Sheet composites generally like the sheet composites 70 illustrated in FIG. 8 were made using the paper and release materials described in Example 1, the double coated and transfer tapes respectively commercially designated "9415" and "Scotch" #945 that are available from Minnesota Mining and Manufacturing company. The coatings 98 of release material which were 25 millimeters wide and were located 17 millimeters from one edges of the sheets, were applied in the manner described in Example 1. The coatings 96 of release material were similarly applied 2 millimeters from the opposite edges of the sheets. The layers 97 adhesive were provided by laminating 12 millimeter wide stripes of the "945" transfer tape 2 millimeters from the edges of the sheets. The layers 94 of adhesive were provided by laminating strips of the "9415" double coated tapes on the sheets 25 millimeters from their edges. The sheets were microperforated to form the paths of weakness 88 and 89. The sheet composites 70 were folded along the lines of weakness 88 and 89 to the ready position illustrated in FIG. 8. The sheet composites 70 were printed with a Hewlett Packard "LaserJet III" laser printer. The secondary and third sheet portions 77 and 82 were separated from the primary sheet portions. The third sheet portion of one sheet composite was adhered to a cabinet by the layer 97 of adhesive, and a photograph was adhered to the layer 94 of adhesive. The testing described above was performed on the sheet composites 70 and showed that the force required to separate the secondary sheet portions from the primary sheet portions after their primary and secondary sheet portions were adhered together by the layer of adhesive in their ready position but prior to printing was about 2 and 6 grams per inch respectively for the adhesives 94 and 97, and that the force required to separate the secondary sheet portions from the primary sheet portions after they are printed was about 6 and 13 grams per inch respectively for the adhesives 94 and 97.

EXAMPLE 5

Sheet composites generally like the sheet composites 100 illustrated in FIG. 9 were made from the sheets described in Example 3 by cutting the microperforation from the edge of the sheets to form two separate sheets 101 and 107. Those sheet composites 100 were printed and put to use as a note and a complimentary flag. The testing described above was performed on the Sheet composites 100 and showed essentially the same values reported above in Example 3.

EXAMPLE 6

A stack of sheet composites like that illustrated in FIG. 2 were made from sheet composites 10 of the type described in Example 1 by applying the coating 27 of release material to their second surfaces 14 and 19. The material for the release coating was prepared in accordance with the teachings in U.S. Pat. No. 5,154,962 (Mertens, et. al.), Example 41, except the material was made in 55 gallon reactors, and the chemical composition was 47.0 percent methyl acrylate, 36.5 percent n-vinyl pyrrolidone, 5.3 percent acrylic acid, and 31.3 percent silicone macromer. The coatings 27 of release material were applied to 10 of the sheet composites 10 using a smooth rod, and dried. The sheet composites were stacked to form the pad as illustrated. The pad was then placed in a dispenser generally of the type illustrated in U.S. Pat. No. 4,986,440 from which the sheets were conveniently dispensed and could be used either as a note without printing them, or could be folded along the path of weakness 23, printed and then used.

EXAMPLE 7

Sheet composites generally like the sheet composites 10 illustrated in FIG. 1 were made using 60 pound clay coated paper. Release material for the coatings 26 was prepared by mixing 95 parts of "Syl-off" 7610 and 5 parts of "Syl-Off" 7611 (both commercially available from Dow Corning Corp.), diluted to 10 percent solids in 2-butanone. The coatings 26 of release material were applied as in Example 1. Adhesive for use in the layers 24 of adhesive was provided by "Scotch" 924 adhesive transfer tape. Subsequently, the sheets were microperforated to form the paths of weakness 23. The secondary sheet portions 17 were rotated about the paths of weakness 23 to adhere the layers 24 of adhesive to the coatings 26 of release material. The resultant sheet composites 10 were printed on their second surfaces using the Hewlett Packard "LaserJet III" laser printer. Some of the printed sheet composites were unfolded and attached to substrates including brick walls as signs. Separation of the sheet portions caused some delamination of the paper and caused the paper to curl. The testing described above was performed on the sheet composites and showed that the force required to separate the secondary sheet portions from the primary sheet portions after their primary and secondary sheet portions were adhered together by the layer of adhesive in their ready position but prior to printing was about 75 grams per inch, and that the force required to separate the secondary sheet portions from the primary sheet portions after they are printed was about 280 grams per inch.

The present invention has now been described with reference to several embodiments thereof. It will be apparent to those skilled in the art that many changes can be made in the embodiments described without departing from the scope of the present invention. For example, the paths of weakness between the sheet portions can be provided in many ways other than perforations that will bind the edges of the sheet portions together and allow the sheet portions to be pivoted relative to each other along the paths of weakness while providing sufficient integrity so that the sheets do not separate along that line while being printed, and can, if desired be torn apart along the line of weakness. Those ways include weakening a sheet of material by crushing or scoring the sheet, chemical treatments, and the like, and where two sheets are used to form the sheet portions by gluing their adjacent edges together or joining their adjacent edges by a length of adhesive coated tape or the like. Thus, the scope of the present invention should not be limited to the structures and methods described in this application, but only by the structures and method described by the language of the claims and the equivalents thereof.

I claim:

1. A method for printing a custom printed sheet comprising the steps of:

providing a printer of the type commonly used with personal or other types of computers such as a laser printers, an ink jet printer, or an impact printer, providing a manually operable means for forming indicia in digital form capable of operating the printer in a manner such that the printer will print the message when the printer is actuated and the electronic form of the message is sent to the printer;

providing a sheet composite comprising a primary sheet portion having opposite first and second major surfaces of a size adapted to be received by the printers and having first and second opposite edges, a secondary sheet portion having first and second opposite major surfaces and having first and second opposite edges, said secondary sheet portion having a width between said first and second edges that is no more than half the width of the primary sheet portion between the first and second opposite edges of the primary sheet portion, the first surface of said secondary sheet being positioned adjacent the first surface of the primary sheet with the first edges of said primary and secondary sheets generally aligned; and a layer of pressure sensitive adhesive extending between the adjacent first surfaces of said sheet portions, said adhesive being firmly adhered on the first surface of one of said sheet portions and being releasably adhered on the first surface of the other of said sheet portions, the force required to peel apart the sheet portions prior to printing the sheet composite in a printer being greater than about 5 grams per 25 millimeter of adhesive width along the peel line when the sheet portions are peeled apart at a 90 degree angle at 300 millimeters per minute;

forming a desired message using the manually operable means;

actuating the printer;

sending the message in its electronic form to the printer;

feeding the sheet composite through the printer so that the message is printed on the sheet composite;

separating the secondary sheet portion from the primary sheet portion so that the printed sheet composite can be adhered to a substrate using the layer of pressure sensitive adhesive.

2. A method according to claim 1 wherein said step of providing a sheet composite includes the sequential steps of:

initially providing the sheet composite with means joining the first edges of the primary and secondary sheet portions, with the first surfaces of the primary and secondary sheet portions generally coplaner, with the layer of adhesive only adhered to one of the first surfaces, and with a path of weakness between the sheet portions; and manually bending the sheet along the path of weakness prior to the feeding step to position the first surface of the primary and secondary sheet portions adjacent so that the layer of pressure sensitive adhesive is adhered along the first surfaces of both of the sheet portions.

3. A method according to claim 2 wherein in said step of initially providing the sheet composite the sheet composite is provided as one of a plurality of sheet composites having essentially the same structure, with the layers of adhesive on the sheet composites being adhered to the second surfaces of adjacent sheet composites to form a stack; and said step of initially providing the sheet composite includes the step of removing the sheet composite from the stack.

4. A method according to claim 1 wherein said step of providing a sheet composite includes the sequential steps of:

initially providing the sheet composite with the primary and secondary sheet portions being a single sheet so that the first edges of the primary and secondary sheet portions of the sheet composite are joined, with the first surfaces of the primary and secondary sheet portions generally coplaner, with the layer of adhesive only adhered to one of the first surfaces, and with the sheet having a path of weakness between the sheet portions; and manually bending the sheet along the path of weakness prior to the feeding step to position the first surface of the primary and secondary sheet portions adjacent so that the layer of pressure sensitive adhesive is adhered along the first surfaces of both of the sheet portions.

5. A method according to claim 4 wherein in said step of initially providing the sheet composite the sheet composite is provided as one of a plurality of sheet composites having essentially the same structure, with the layers of adhesive on the sheet composites being adhered to the second surfaces of adjacent sheet composites to form a stack; and said step of initially providing the sheet composite includes the step of removing the sheet composite from the stack.

6. A method according to claim 1 wherein the primary and secondary sheet portions are two portions of a single sheet, said single sheet being bent along said first edges to position the first surface of the secondary sheet adjacent the first surface of the primary sheet; the layer of adhesive is firmly adhered on the first surface of the secondary sheet portion; and said method further includes printing a plurality of custom printed sheets using the method steps set out above; and adhering the layers of adhesive on the secondary sheets to the second surfaces of other secondary sheets with the edges of the secondary sheets aligned to form a pad or booklet.

7. A method according to claim 1 wherein the primary and secondary sheet portions are two portions of a single sheet, which sheet is bent along said first edges to position the first surface of the secondary sheet adjacent the first surface of the primary sheet; said sheet is perforated between said primary and secondary sheet portions; said layer of adhesive is firmly adhered on the first surface of said primary sheet portion; and said step of separating the secondary sheet portion from the primary sheet portion includes the step of separating the sheet portions along the perforations therebetween.

* * * * *